United States Patent [19]

Fischer et al.

[11] Patent Number: 4,993,503

[45] Date of Patent: Feb. 19, 1991

[54] HORIZONTAL BORING APPARATUS AND METHOD

[75] Inventors: Edward E. Fischer, Acton; Thomas H. Mann, Littleton; Allan T. Fisk, Needham, all of Mass.

[73] Assignee: Electric Power Research Institute, Palo Alto, Calif.

[21] Appl. No.: 499,782

[22] Filed: Mar. 27, 1990

[51] Int. Cl.[5] ..... E21B 7/08; E21B 7/18; E21B 47/09; E21B 47/12

[52] U.S. Cl. ..... 175/62; 175/45; 175/67; 175/73; 175/400; 175/410

[58] Field of Search ..... 175/61, 62, 73, 67, 175/41, 45, 400, 410, 424

[56] References Cited

U.S. PATENT DOCUMENTS

| | | | |
|---|---|---|---|
| 2,075,064 | 3/1937 | Schumacher et al. . | |
| 2,153,680 | 4/1939 | Schumacher et al. | 175/231 |
| 2,196,940 | 4/1940 | Potts | 175/231 |
| 2,324,102 | 7/1943 | Miller et al. | 175/231 |
| 2,350,986 | 6/1944 | Collins | 175/231 |
| 2,686,660 | 8/1954 | Storm | 175/321 |
| 2,873,092 | 2/1959 | Dwyer | 175/61 |
| 2,903,239 | 9/1959 | Standridge | 175/231 |
| 3,211,244 | 10/1965 | Cordary | 175/231 |
| 3,365,007 | 1/1968 | Skipper | 175/231 |
| 3,419,091 | 12/1968 | Gardner | 175/67 |
| 3,467,211 | 9/1969 | Goodwin et al. | 175/422 |
| 3,645,346 | 2/1972 | Miller et al. | 175/231 X |
| 3,712,391 | 1/1973 | Coyne | 175/26 |
| 3,878,903 | 4/1975 | Cherrington | 175/45 |
| 4,396,073 | 8/1983 | Reichman et al. | 175/74 |
| 4,679,637 | 7/1987 | Cherrington et al. | 175/61 |
| 4,714,118 | 12/1987 | Baker et al. | 175/26 |
| 4,787,463 | 11/1988 | Geller et al. | 175/45 |
| 4,856,600 | 8/1989 | Baker et al. | 175/62 X |
| 4,858,705 | 8/1989 | Thiery | 175/73 |
| 4,867,255 | 9/1989 | Baker et al. | 175/62 X |

FOREIGN PATENT DOCUMENTS

| | | |
|---|---|---|
| 2126267 | 3/1984 | United Kingdom . |

*Primary Examiner*—Stephen J. Novosad
*Attorney, Agent, or Firm*—Fish & Richardson

[57] ABSTRACT

Boring apparatus for forming a generally horizontal underground passage for a utility conduit or the like that includes a tool head with elongated body structure and a cutting face of ellipto-conical form at one end of the elongated body structure. The cutting face has a major axis and a minor axis and cutting bit structure is fixed to and projects forwardly from the cutting face and extends substantially the full width of the cutting face generally along the major axis. The tool head also includes coupling structure for attaching the tool head to a drill string such that the cutting tool face is offset from the drill string axis. Structure in the cutting face defines a cutting fluid orifice adjacent the cutting bit structure for directing a high velocity jet of cutting fluid forwardly of the cutting tool face. The tool body is adapted to be advanced and concurrently driven in rotation to move the cutting face in orbital boring action about the drill string axis to bore an underground passage and to be advanced without rotation to produce a change in direction of the underground passage in the direction of offset from the drill string axis.

26 Claims, 6 Drawing Sheets

HORIZONTAL BORING APPARATUS AND METHOD

This invention relates to methods and apparatus for boring underground horizontal passageways.

Horizontally bored underground pathways for piplines and utilities such as electrical distribution lines provide a safe, economical and environmentally responsible alternative to digging through or building over natural terrain and manmade obstacles.

A wide variety of drilling methods and apparatus for boring underground passageways used for installing utility cables, pipes and the like are known. Such methods and apparatus should be capable of cutting passageways through a wide variety of soil types to properly receive the pipeline or utility line. Frequently, changes in direction of the underground passage are required, due to layout considerations or to underground obstructions such as other utility lines, for example. In addition, the subsoil conditions may include smaller obstacles such as rocks of modest size which may interfere with efficient drilling.

In accordance with one aspect of the invention, there is provided boring apparatus for forming a generally horizontal underground passage for a utility conduit or the like that includes a tool head with elongated body structure and a cutting face of ellipto-conical form at one end of the elongated body structure. The cutting face has a major axis and a minor axis and cutting bit structure is fixed to and projects forwardly from the cutting face and extends substantially the full width of the cutting face generally along the major axis. Structure in the cutting face defines a cutting fluid orifice adjacent the cutting bit structure for directing a high velocity jet of cutting fluid forwardly of the cutting tool face. The tool head also includes coupling structure for attaching the tool head to a drill string such that the cutting tool face is offset from the drill string axis. The tool body is adapted to be advanced and concurrently driven in rotation to move the cutting face in boring action about the drill string axis to bore an underground passage and to be advanced without rotation to produce a change in direction of the underground passage in the direction of offset from the drill string axis.

In preferred embodiments, the tool body is of steel and the cutting bit structure is of material such as tungsten carbide that is harder than the tool body material, the tool body transitions from substantially circular form of diameter substantially the same as the diameter of the drill string adjacent the coupling structure to elliptical form adjacent the cutting face, the length of the major axis is greater than the diameter of the drill string, and a plurality of cutting fluid orifices are in the cutting face.

Preferably, the length of the major axis of the ellipto-conical face is at least twenty five percent greater than the length of the minor axis, the center of the cutting tool face is offset from the drill string axis a distance that is at least ten percent of the diameter of the base portion of the tool head, and the diameter of the orbital path of the cutting bit structure is at least about twenty-five percent greater than the diameter of the base portion of the tool head.

In particular embodiments, each cutting fluid orifice in the cutting face includes a nozzle with an orifice of less than three millimeters diameter, and each nozzle is adapted to direct a high velocity jet of cutting fluid at a different angle in the plane of the major axis and at an angle in the plane of the minor axis that is greater than the angular offset of the tool head axis to the drill string axis.

In a particular embodiment, the tool head includes second cutting bit structure fixed to and projecting forwardly from the cutting face and extending generally along the minor axis.

In accordance with another aspect of the invention, there is provided dual mode boring apparatus for forming a generally horizontal underground passage for a utility conduit or the like that includes a tool head with elongated body structure that defines a tool axis and structure defining a cutting face at one end of the elongated body structure, cutting bit structure fixed to and projecting forwardly from the cutting face. The cutting bit structure includes pilot structure that defines a pilot axis offset from the tool axis. Structure defining a cutting fluid orifice is in the cutting face adjacent the cutting bit structure for directing a high velocity jet of cutting fluid forwardly of the cutting face, and coupling structure is adapted to attach the elongated body structure to a drill string such that the cutting tool face is offset from the drill string axis. The tool body is adapted to be advanced and concurrently driven in rotation to move the cutting face in an orbital path about the tool axis in boring action in relatively soft underground strata and to move the cutting face in a rotary path about the pilot structure in rotary boring action in underground strata that is harder than the relatively soft underground strata to bore an underground passage, and to be advanced without rotation to produce a change in direction of the underground passage in the direction of offset of the pilot structure from the tool axis.

In accordance with still another aspect of the invention, there is provided a method for forming a generally horizontal underground passage for a utility conduit or the like that includes the steps of providing a tool head that has elongated body structure and a cutting face at one end of the elongated body structure, cutting bit structure fixed to and projecting forwardly from the cutting face, and structure defining a cutting fluid orifice in the cutting face adjacent the cutting bit structure; attaching the elongated body structure to a drill string such that the cutting tool face is offset from the axis of the drill string; concurrently rotating and advancing the tool body along an underground path to move the cutting face in orbital boring action about the drill string axis while concurrently directing a high velocity jet of cutting fluid from the orifice defining structure at an angle to the drill string axis in the same direction as the cutting tool face is offset from the drill string axis to bore a substantially straight underground passage; and advancing the tool body along an underground path without rotation while concurrently directing the high velocity jet of cutting fluid from the orifice defining structure at an angle to the drill string axis in the same direction as the cutting tool face is offset from the drill string axis to produce a change in direction of the underground passage in the same direction as the cutting tool face is offset from the drill string axis. Preferably, the jet of cutting fluid is flowed from the orifice defining structure at a velocity of at least about thirty meters per second.

In preferred embodiments, the elongated body structure includes a portion that extends at an angle to the tool axis, the cutting face is of ellipto-conical form, the cutting bit structure includes pilot structure that defines a pilot axis offset from the tool axis, the coupling structure is adapted to attach the elongated body to a drill string so that a portion of the elongated body is at an angle to the axis of the drill string, the pilot axis is at an angle to the drill string axis, and the direction of the high velocity jet is in the same direction and at a greater angle than the angle of the pilot axis to the axis of the drill string. The cutting fluid orifice defining structure includes a plurality of the cutting fluid orifices in the cutting face, and each cutting fluid orifice in the cutting face includes a nozzle with an orifice of less than three millimeters diameter. The tool head is preferably of ferrous material, the cutting bit structure is of carbide material, and in a particular embodiment the cutting bit structure includes first and second cutting bit members, the second cutting bit member being fixed to and projecting forwardly from the cutting face and extending generally perpendicularly to the first cutting bit member.

Other features and advantages of the invention will be seen as the following description of particular embodiments progresses, in conjunction with the drawings, in which:

FIG. 1. is a diagrammatic illustration of operation of horizontal boring apparatus according to the invention;

Figure 3:
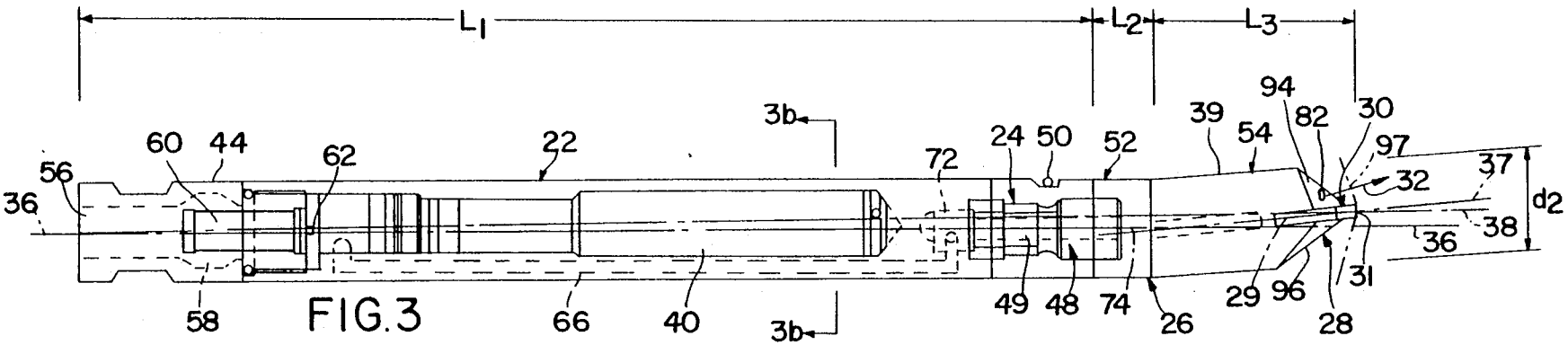
FIG. 3 is a side view of the cutting tool of FIG 2.
Figure 3A:
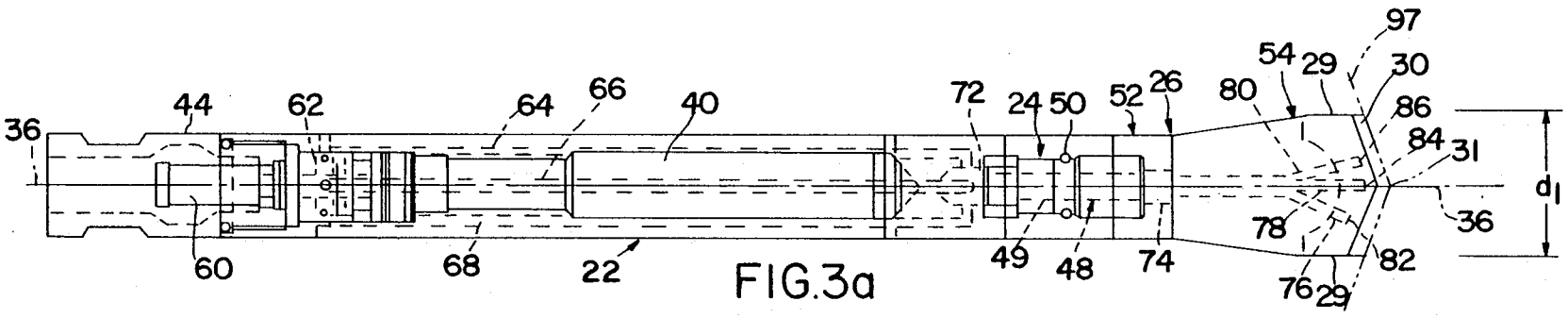
Figure 3B:
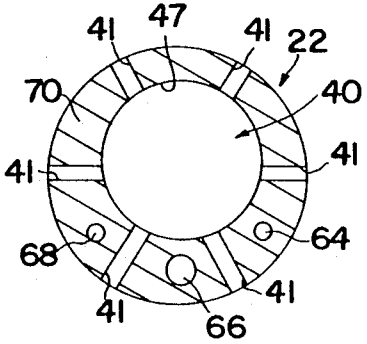
Figure 4:
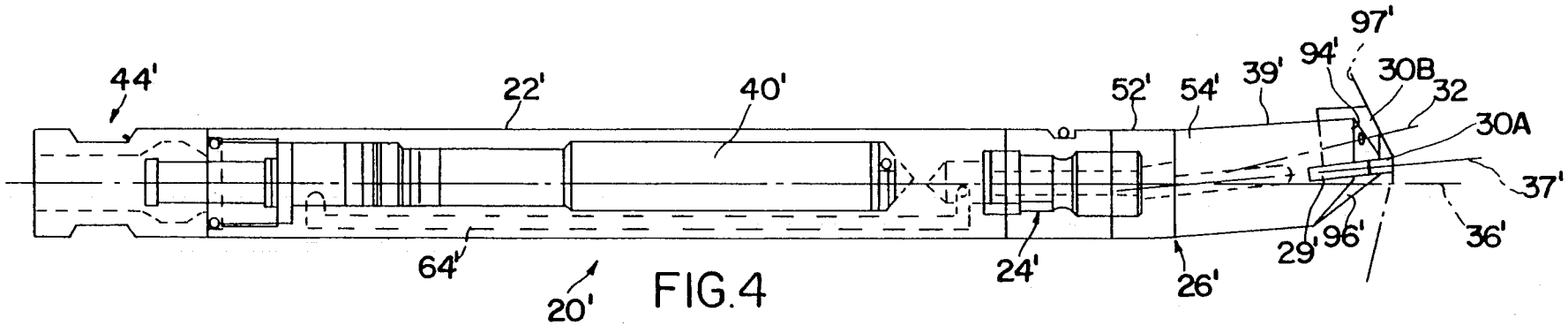
Figure 4A:
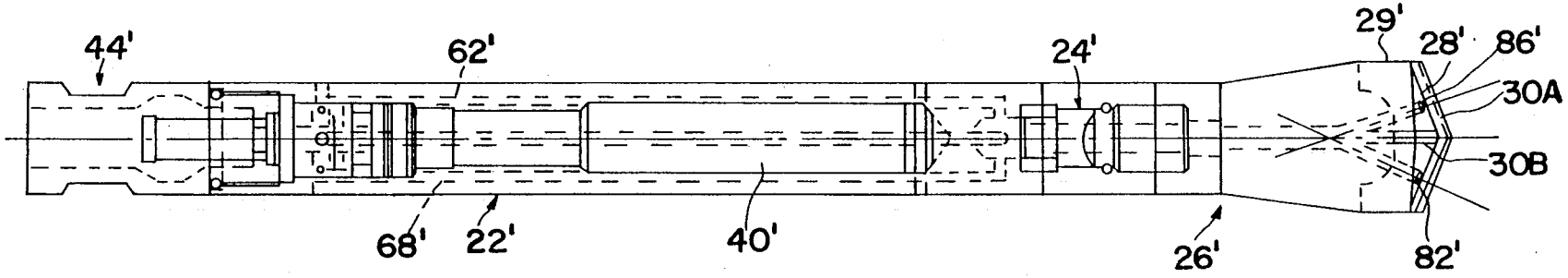
Figure 3C:
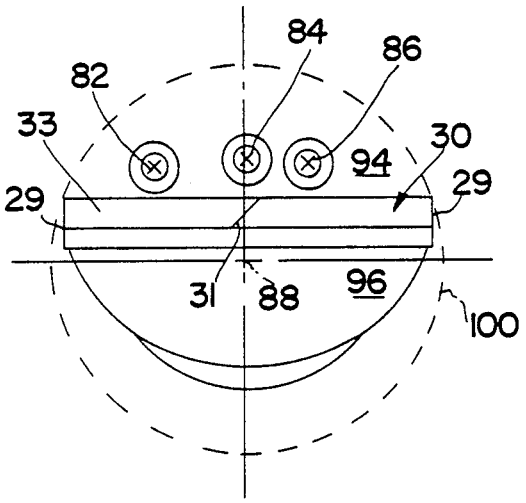
Figure 3D:
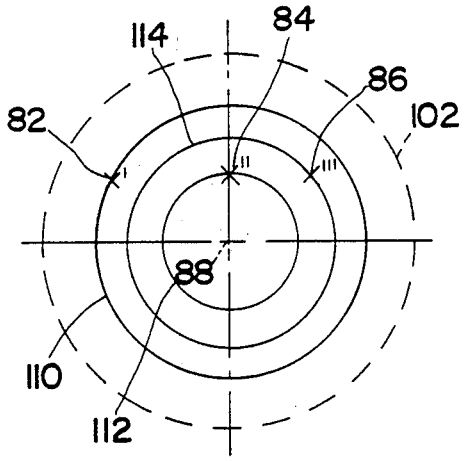
Figure 3E:
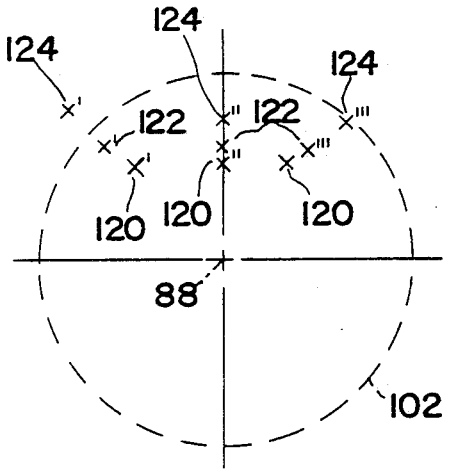
Figure 4B:
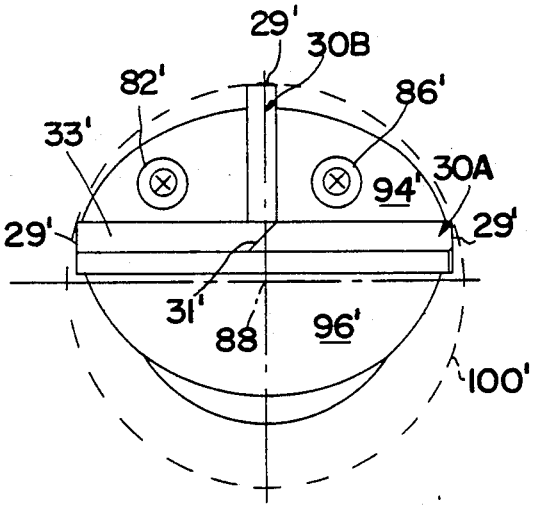

FIG. 3*a* is a top view of the cutting tool of FIG. 3;

FIG. 3*b* is a cross section of the cutting tool of FIG. 3 taken along the line 3*b*—3*b* of FIG. 3;

FIG. 3*c* is a front view of the face of the cutting tool of FIG. 3;

FIG. 3*d* illustrates the direction of the paths traveled by jet streams emanating from the tool in FIG. 3;

FIG. 3*e* illustrates the location of liquid jet streams emanating from jet nozzles on the tool in FIG. 3, at different distances from the cutting face of the tool;

FIG. 4 is a side view of another embodiment of a boring tool of/the invention;

FIG. 4*a* is a top view of the tool in FIG. 4;

FIG. 4*b* is a front view of the tool of FIG. 4; and

Figure 5A:
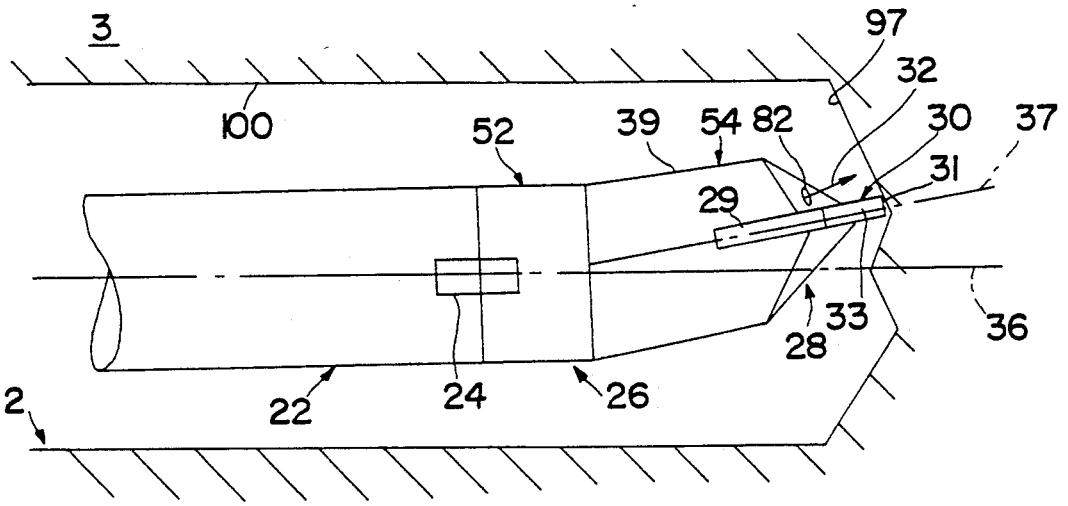
Figure 5B:
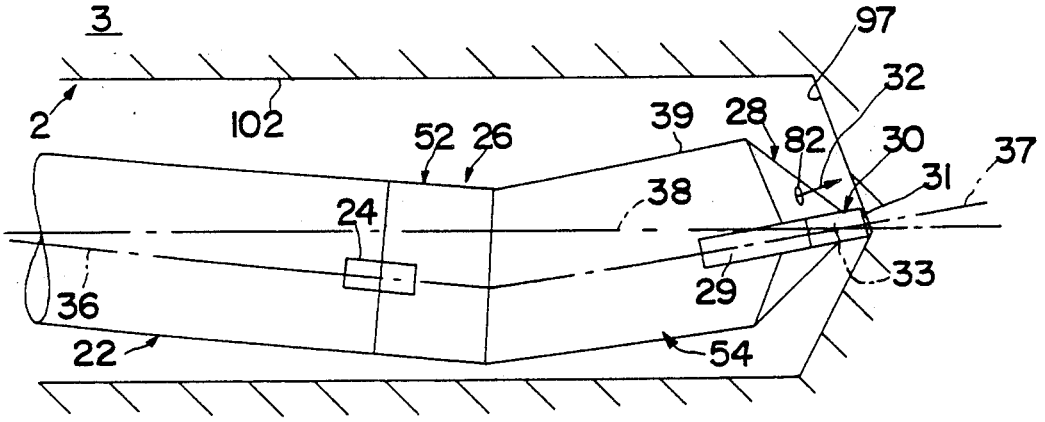

FIGS. 5*a* and 5*b* are diagrammatic views of operation of the boring system of FIG. 3 in orbital mode and in rotary mode, respectively.

DESCRIPTION OF PARTICULAR EMBODIMENTS

Figure 1:
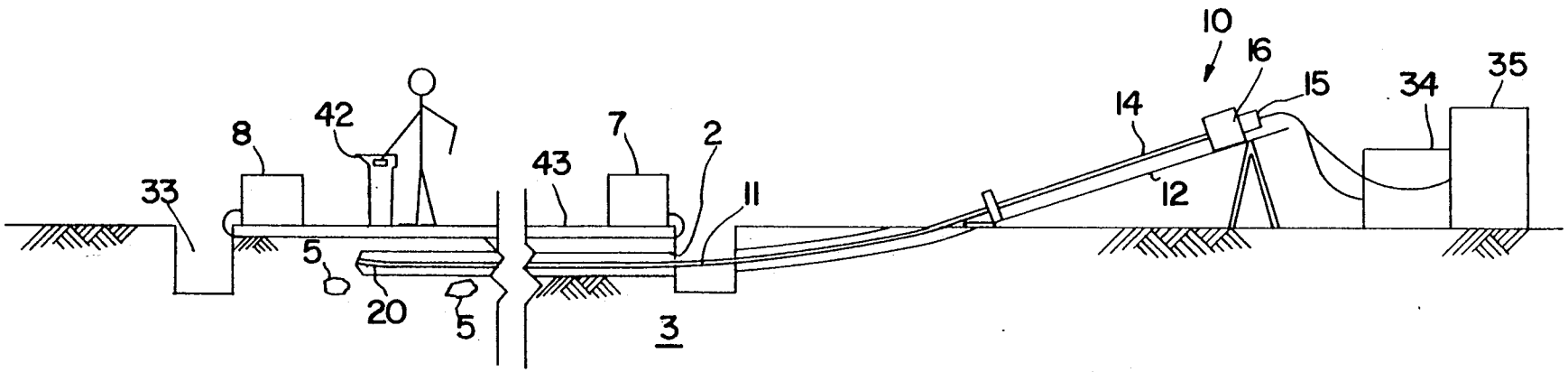

The schematic diagram of FIG. 1 shows a system for boring horizontal underground passageway 2 through strata 3 that may be relatively unconsolidated soil such as gravel with spaced obstructions such as moderately sized rocks 5 (or more consolidated material such as relatively hard rock) for an electric cable interconnection between transformers 7 and 8. Drill rig 10 is positioned slightly behind a pre-dug pit 11 adjacent transformer 7 and the frame 12 of rig 10 is inclined to give drill string 14 a suitable entry angle into the soil 3. Typically the entry angle is from ten to forty-five degrees The drill string 14 is a series of drill pipe sections of the type connectable end to end by having a female coupling on one end and a male coupling on the other end. The sections rotate together but allow for limited off axis flexing motion relative to one another to allow the drill string 14 to follow the curvature of the desired passage 2.

Motor 15, on translatable carriage 16 on the rig 10, rotates drill string 14 and urges the drill string forward on tracks or guides in frame 12 to push the drill string 14 through strata 3. When the carriage 16 reaches the end of its stroke, the drill string 14 is disconnected from the rig 12, the carriage 16 pulled back and an additional length of drill pipe is inserted.

Figure 2:
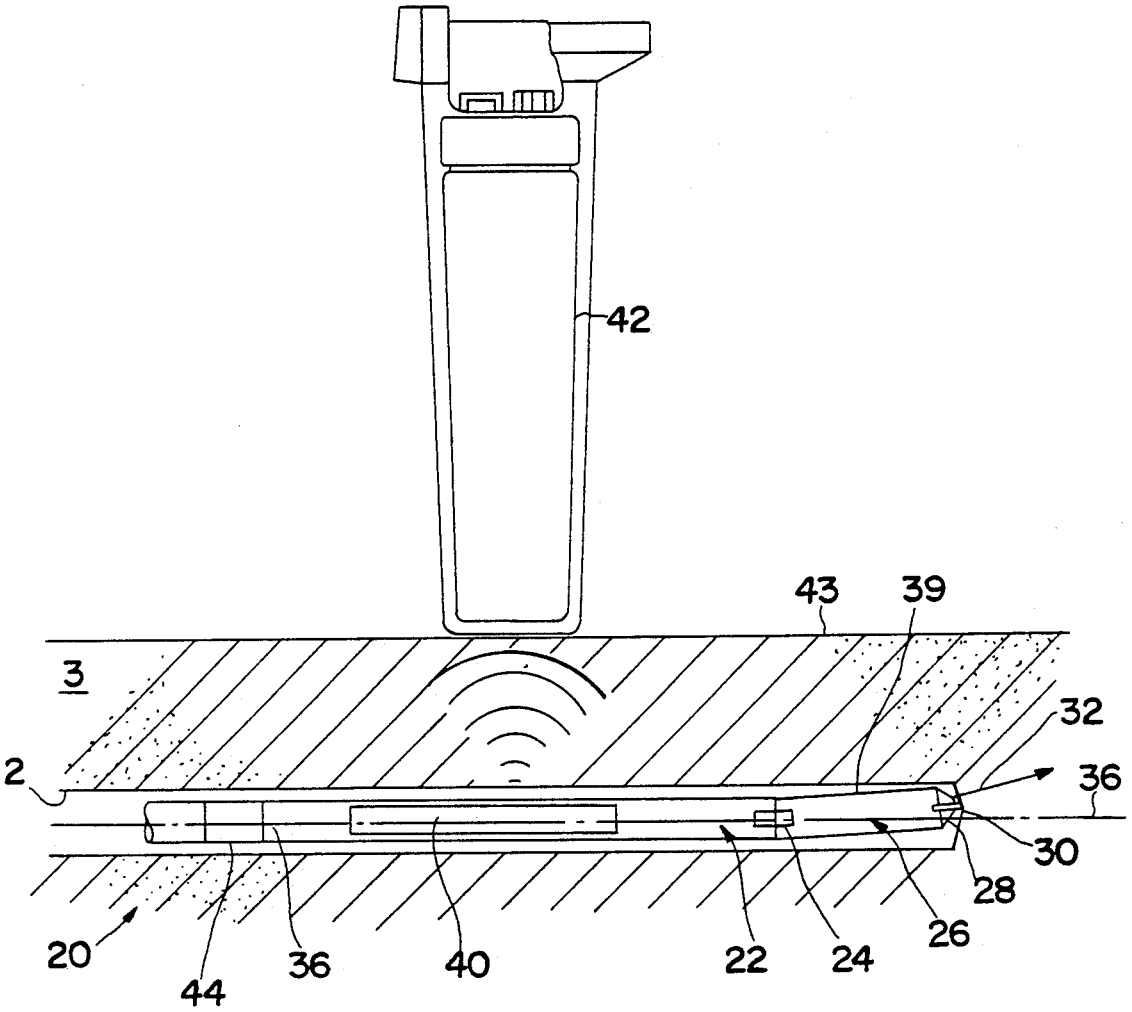
FIG. 2 is an enlarged view of the cutting tool at the end of the boring apparatus of FIG. 1.

Referring now to FIG. 2, at the forward end of the drill string 14 is tool assembly 20. The tool assembly includes elongated body 22, coupling 24 at one end of body 22 that couples tool head 26 to body 22, tool head 26 having cutting face 28. Tungsten carbide bit 30 projects forward from face 28 and three jet orifices are adjacent cutting bit 30 As the tool rotates, strata 3 such as packed soil or rock is cut by concurrent action of carbide bit 30 and high velocity cutting jets 32 from the jet orifices adjacent cutting bit 30. The drilling fluid (typically water or a bentonite and water mixture) is pumped with pump 34 (FIG. 1) from a nearby tank 35 to rig 10 and through drill string 14. The fluid jets 32 are of sufficiently high pressure to cut soil and soft to medium strength rock and dislodge and displace material as the tool advances, while cutting bit 30 cuts rock of greater strength as well as supplementing the cutting of soil and soft to medium strength rock by jets 32. The mud also impregnates the surrounding soil and lines the passage 2 with a mud "cake" so that the passage 2 does not collapse around drill string 14 during drilling or after the drill string 14 has been removed from the passage.

As illustrated in FIGS. 2 and 5, the tool head 26 offsets the cutting bit 30 on the face of the tool head 26 from the drill string and tool body axes 36 along pilot axis 37. When the drill string is rotated as it is thrust forward in relatively soft strata, cutting face 28 operates in orbital mode, and drills a straight line passageway larger than the diameter of the tool body 22. In harder strata, cutting face 28 operates in rotary mode about chordal axis 38 that is defined by coupling 44 and apex 31 and forms a passageway of somewhat smaller diameter than the passageway diameter formed in orbital mode drilling. Tool face 28 is of ellipto conical shape with a major axis of the ellipse longer than the diameter of tool body 22.

The tool may also be operated to change the direction of the passage 2. Rotation is stopped such that flank 39 of tool head 26 is on the inside of the desired turn. When the tool is thrust forward without rotation, the offset cutting bit 30 of the tool head 26 and the jets 32 dig into the strata 3 and cause the tool assembly 20 to change the direction of tool body axis 36. After this procedure, rotation may be resumed for straight-ahead cutting in the new direction.

In order to track the location of and to guide the direction of the tool 20, the tool is equipped with a compact electromagnetic transmitter 40 and a mercury switch orientation assembly that shifts the transmitter output between continuous mode and intermittent mode operation in each rotation to provide an indication of the rotational angular orientation of tool head 26. Transmitter 40 emits an electromagnetic signal at thirty three kilohertz frequency through slots 41 for detection by conventional detector 42 located above the ground surface 43 (FIG. 2).

Further details of boring tool assembly 20 may be seen with reference to FIGS. 3—3*e*. The drill string includes a coupler that is screwed into threaded coupler 44 to fix tool body 22 to and for rotation with the drill string 14; 4140 steel body 22; male female coupler assembly 24, and 4140 steel tool head 26 with cutting face 28. The female portion of coupler 24 is welded to the forward end of body 22 and receives hexagonal male fitting 48 that is welded to tool head 26. Staple 50 engages male fitting 48 and secures tool head 26 to tool body 22 and enables removal of tool head 26 for easy interchange of tool heads of different angles and offsets. In the illustrated embodiment, the length ($L_1$) of the tool body 22 is about 43 centimeters. The tool head 26 includes cylindrical portion 52 of about 2.5 centimeter length ($L_2$) and flared portion 54 of about 8.5 centimeter length ($L_3$) which extends along pilot axis 37 at an angle of about 5° with respect to axis 36 of tool body 22. The apex 31 of carbide bit 30 at cutting face 28 (which defines pilot axis 37) is offset about 0.8 centimeter ($L_4$) from tool axis 36 at cutting face 28.

Drilling fluid flows as indicated by arrows from the drill string through central passage 56 in drill string coupler 44. The coupler 44 and the immediately adjoining portion of body 22 define a chamber 58 which receives filter member 60. Drilling fluid passes radially through filter 60 to strain out large particulate matter which might otherwise clog the fluid jet nozzles. The outlet end of the filter 60 mates with manifold 62 that distributes drilling fluid to conduits 64, 66, 68 in the wall 70 of body member 22 (FIG. 3*b*).

As indicated in FIG. 3*b*, the conduits 64, 66, 68 enable the fluid flow to be directed around central chamber 47 in the body 22 in which transmitter 40 is positioned. The conduits terminate in a central flow passage 72 in body portion 22 which feeds through passage 49 in male coupler fitting 48 and into passage 74 in body portion 52 and thence to three splayed passages 76, 78, 80 in flared tool head portion 54 that lead to jet nozzles 82, 84, 86, respectively, for forming splayed jet streams. Nozzles 82, 84, 86 are of the sapphire type of about one millimeter diameter opening. The pressure of the fluid may range from very low pressures in which case the streams provide primarily a washing function on the bit 30 (as low as 100 psi) to medium to high pressure (up to 10,000 psi) in which case soft to medium hardness strata may be cut by the jets 32. Typically, cutting pressures are in the range of 1500–3000 psi and jet velocities of about 150 meters per second are produced.

As shown in FIG. 3*a*, body portion 52 is nominally cylindrical and has a diameter of about four centimeters. As it extends toward the end of the tool, portion 52 transitions to flared portion 54. At the forward end of portion 54, at the widest portion, the ellipse has a major axis of about 5.7 centimeters ($d_1$) and a minor axis of about 4.1 centimeters ($d_2$). The diameter of drill string 14 is about the same as the diameter of tool body portion 22.

The cutting face 28 of tool head 26 is of asymmetrical ellipto-conical configuration with upper flank 94 and lower flank 96 separated by tungsten carbide cutting bit 30 oriented along the major axis of the expanding oval shape of the tool head 26 (FIG. 3*c*). The three jet nozzles 82, 84, 86 are positioned on upper flank 94 of the face of the cutting tool, set back from the frontmost portion of the tool so that carbide bit 30 affords some protection for the nozzles 82, 84, 86. Surface 97 represents the generally conical end of the passage 2 cut by blade 30. Carbide bit 30 is about 5.7 centimeters wide and about 0.5 centimeter thick, and has a generally rectangular shape with a triangular outer cutting surface 33 that forms pilot apex 31. Bit 30 is brazed into a slot in cutting face 28 at the end of the tool head 26 such that the exposed cutting surfaces 33 of the bit 30 make an angle of about 20° with respect to the major axis of the ellipse. The radially-outermost axially-extending surfaces 29 of bit 30 are beveled at about 7°.

An end view of face 28 of cutting tool 26 is shown in FIG. 3*c*, and diagrammatic side views are shown in FIG. 5. The axis of passage 2 corresponds to tool axis 36 which intersects cutting face 28 at point 88 in orbital mode. The wall of the passage 2 that is cut in orbital mode is represented by dash line 100 in FIG. 3*c*, which is generated by the diameter that edges 29 of bit 30 travel as tool face 28 orbits about tool axis 36. The dash line 100 represents the six centimeter nominal passage size that will be bored by the tool in orbital mode, and that diameter is somewhat greater in soil types such as normal top soil or sand as the fluid cutting jets 32 provide substantial supplemental cutting action. In harder and more cohesive materials such as weak rocks and hard clay, face 28 rotates about chordal axis 38 (that intersects and extends forwardly from bit apex 33), blade 30 providing most of the cutting action The diameter $d_1$, of the passage 102 bored in rotary mode, is about 5.7 centimeters. Thus the minimum ratio of the passage diameter to drill string diameter for this embodiment, is about 1.4.

Referring back now to FIGS. 3 and 3*a*, the jets 32 from nozzles 82, 84, 86 are angled at 13° from axis 36 of the tool body in the plane of the minor axis as viewed in FIG. 3. Additionally, the jets are splayed in different directions in the plane of the major axis as viewed from FIG. 3*a*. Nozzle jet 82 splayed at 24° to one side of axis 36, jet nozzle 86 is splayed at 18° to the opposite side of axis 36, and jet nozzle 84 is at zero degrees (not splayed) in this embodiment. This angled and splayed configuration distributes the jet cutting action over a larger proportion of end surface 97 of the borehole in strata 3 and enables the jets to cut a wider path in soft soil, forming an even larger lumen than provided by bit 30 alone.

FIG. 3*d* illustrates the location of the liquid streams at the tool face where they emerge from the jet nozzles and strike the strata contacted by the bit 30 in rotary mode, i.e., surface 97 in FIGS. 3, 3*a* and 5*b*. As indicated, the stream positions indicated by X′ (nozzle 82), X″ (nozzle 84), and X‴ (nozzle 86), are located at different diameters 110, 112, 114 within the passage 2 formed as the tool rotates.

In FIG. 3*e*, the position of the jet streams 32 in rotary mode are shown at different distances from the nozzles 82, 84, 86. The positions of the streams 32 as they emerge from the nozzles are indicated by marks 120; the positions on surface 97 in FIG 3 and 3*a* are indicated by marks 122; and the positions at an arbitrary surface C about 1.2 centimeters in front of the tool are indicated by marks 124 in FIG. 3*e*. As is clear from FIG. 3*e*, the jets 32 have an effect on hole size as the distance from the nozzles to the end of the bore 2 increases.

Typically, the tool 20 is used to produce a pilot tunnel 2. After the tool 20 has arrived at its destination, the tunnel 2 may be enlarged by reaming. This may be done as conventionally known by removing the tool assembly 20 at the receiving pit 33 adjacent transformer 8 and replacing it with a back reamer (not shown). The back reamer enlarges the hole as the drill string is rotated and pulled back to starting pit 11. A pipe or electric cable may also be pulled into the hole during back reaming. The back reaming tool may be entirely mechanical or entirely a fluid jet cutting tool or a combination of the two depending on soil conditions.

The tool design also assists in drilling a curved path while being thrust forward without rotation. The jet streams 32 are oriented in the general direction of the intended curved drill path, i.e. in the same off angle direction as pilot axis 37 and toward the inside of the desired curved path. In addition, the major axis of the oval shape of the cutting face 28 is perpendicular to tool body axis 36, and its wedge face can be pressed into strata 3 with relatively low resistance.

Referring now to FIG. 4, another embodiment of a cutting tool is illustrated. The tool 20' includes body 22', drill string coupler 44', tool head coupler 24', and tool head 26'. Coupler 24' orients pilot axis 37' of tool head 26' approximately 5° off axis from tool body axis 36'. The tool head 26' has a similar ellipto conical configuration as discussed above. In addition, the face 28' includes a first cutting blade 30A arranged along the major axis of the ellipse and a second cutting blade 30B perpendicularly arranged with respect to blade 30A and disposed in face flank 94'. The cutting bit 30B is disposed between a pair of jet nozzles 82', 86', which correspond in position and angular orientation to nozzles 82, 86 of FIG. 3. The bit 30B provides additional protection for the nozzles 82', 86' and is particularly useful in abrasive strata such as sand where cutting bits wear more quickly. The flank face 94' is more blunt than face 94 in order to position and support bit 30B such that its forwardmost edge is essentially coincident with surface 97' and its radial edges 29' contact the perimeter 100' of the nominal drilled tunnel size.

In order to track the location of and to guide the direction of the tool, the tool is equipped with compact electromagnetic transmitter 40' installed within tool body 22'. Transmitter 40' has a mercury switch (or other means) to vary the signal output depending on the rotational orientation of the tool, commonly called "tool face angle," thus enabling the user to determine at least once per revolution (over a span of several degrees) the orientation of tool head 26'. Orientation of tool head 26 (26') is established, and then the tool is slowly rotated in partial revolution until the tool flank 39 (39') is oriented in the desired steering direction. Rotation is stopped again, and the drill string 14 is thrust forward, creating a curved drill path or desired steering maneuver as described above. Receiver 42 is used to detect the electromagnetic signals emanating from the transmitter 40 (40'). Receiver 42 receives and processes the signal from the transmitter and displays an analog or digital (for example, audible) reading indicative of the location, depth and tool face angle of the tool head 26 (26'). This information is then used by the operator to correct and/or steer the tool during continued drilling.

While particular embodiments of the invention has been shown and described, various modifications will be apparent to those skilled in the art, and therefore it is not intended that the invention be limited to the disclosed embodiments or to details thereof, and departures may be made therefrom within the spirit and scope of the invention.

What is claimed is:

1. Dual mode boring apparatus for forming a generally horizontal underground passage for a utility conduit or the like comprising a tool head having elongated body structure that defines a tool axis and structure defining a cutting face at one end of said elongated body structure, cutting bit structure fixed to and projecting forwardly from said cutting face, said cutting bit structure including pilot structure defining a pilot axis offset from said tool axis, structure defining a cutting fluid orifice in said cutting face adjacent said cutting bit structure for directing a high velocity jet of cutting fluid forwardly of said cutting face, and coupling structure for attaching said elongated body structure to a drill string such that said cutting tool face is offset from said drill string axis, said boring apparatus being adapted to be advanced and concurrently driven in rotation to move said cutting face in an orbital path about said tool axis in boring action in relatively soft underground strata and to move said cutting face in a rotary path about said pilot structure in rotary boring action in underground strata that is harder than said relatively soft underground strata to bore an underground passage, and to be advanced without rotation to produce a change in direction of said underground passage in the direction of offset of said pilot structure from said tool axis.

2. The apparatus of claim 1 wherein said tool head is shaped to transition from substantially circular form adjacent said coupling structure of diameter substantially the same as the diameter of the drill string to elliptical form adjacent said cutting face.

3. The apparatus of claim 1 wherein said cutting fluid orifice in said cutting face includes a nozzle with an orifice of less than three millimeters diameter, and said nozzle is adapted to direct a high velocity jet of cutting fluid at an angle to said tool axis that is greater than the angle of offset of said pilot axis from said tool axis.

4. The apparatus of claim 1 wherein said cutting fluid orifice defining structure includes a plurality of said cutting fluid orifices in said cutting face.

5. The apparatus of claim 4 wherein each said cutting fluid orifice in said cutting face includes a nozzle with an orifice of less than three millimeters diameter, and each said nozzle is adapted to direct a high velocity jet of cutting fluid at an angle to said tool axis that is greater than the angle of offset of said pilot axis from said tool axis.

6. The apparatus of claim 1 wherein said cutting bit structure includes first and second cutting bit members, said second cutting bit member being fixed to and projecting forwardly from said cutting face and extending generally perpendicularly to said first cutting bit member.

7. The apparatus of claim 1 wherein said tool head is of ferrous material and the material of said cutting bit structure is harder than said ferrous material.

8. The apparatus of claim 1 wherein said pilot axis at said cutting tool face is offset from said tool axis a distance that is at least ten percent of the diameter of said body structure of said tool head, and the diameter of said orbital path of said cutting face about said tool axis is at least about twenty-five percent greater than the diameter of said body structure of said tool head.

9. The apparatus of claim 1 wherein said cutting face is of ellipto-conical form and has a major axis and a minor axis, and said cutting bit structure extends substantially the full width of said cutting face generally along said major axis.

10. The apparatus of claim 9 wherein said tool body is shaped to transition from substantially circular form adjacent said coupling structure of diameter substantially the same as the diameter of the drill string to elliptical form adjacent said cutting face, and the length of said major axis is greater than the diameter of said drill string.

11. The apparatus of claim 10 wherein said cutting fluid orifice defining structure includes a plurality of said cutting fluid orifices in said cutting face.

12. The apparatus of claim 11 wherein each said cutting fluid orifice in said cutting face includes a nozzle with an orifice of less than three millimeters diameter, and each said nozzle is adapted to direct a high velocity jet of cutting fluid at an angle in the plane of said minor axis greater than the angle of offset of said pilot axis from said tool axis, and each said jet is directed at a different angle in the plane of said major axis.

13. The apparatus of claim 12 wherein said cutting bit structure includes first and second cutting bit members, said second cutting bit member being fixed to and projecting forwardly from said cutting face and extending generally perpendicularly to said first cutting bit member.

14. The apparatus of claim 9 wherein the length of said major axis is at least twenty percent greater than the length of said minor axis.

15. The apparatus of claim 1 wherein said coupling structure is adapted to attach said elongated body structure to a drill string so that said pilot axis is at an angle in the range of about one degree to about fifteen degrees to the axis of said drill string.

16. Boring apparatus for forming a generally horizontal underground passage for a utility conduit or the like comprising a tool head having elongated body structure and a cutting face of ellipto-conical form at one end of said elongated body structure, said cutting face having a major axis and a minor axis, cutting bit structure fixed to and projecting forwardly from said cutting face and extending substantially the full width of said cutting face generally along said major axis, coupling structure for attaching said elongated body structure to a drill string such that said cutting tool face is offset from said drill string axis, and structure defining a cutting fluid orifice in said cutting face adjacent said cutting bit structure for directing a high velocity jet of cutting fluid forwardly of said cutting face, said boring apparatus being adapted to be advanced and concurrently driven in rotation to move said cutting face in orbital boring action about said drill string axis to bore an underground passage and to be advanced without rotation to produce a change in direction of said underground passage in the direction of offset from said drill string axis.

17. The apparatus of claim 16 wherein said elongated body includes a portion that extends at an angle to said tool axis, said cutting bit structure including pilot structure that defines a pilot axis offset from said tool axis, said coupling structure is adapted to attach said elongated body to a drill string so that said portion of said elongated body is at an angle to the axis of said drill string, said pilot axis is at an angle to the axis of said drill string, and the direction of said high velocity jet is in the same direction and at a greater angle to the axis of said drill string than said pilot axis.

18. The apparatus of claim 17 wherein said cutting fluid orifice defining structure includes a plurality of said cutting fluid orifices in said cutting face, each said cutting fluid orifice in said cutting face includes a nozzle with an orifice of less than three millimeters diameter.

19. The apparatus of claim 18 wherein said tool head is of ferrous material and the material of said cutting bit structure is of carbide material, and said cutting bit structure includes first and second cutting bit members, said second cutting bit member being fixed to and projecting forwardly from said cutting face and extending generally perpendicularly to said first cutting bit member.

20. A method for forming a generally horizontal underground passage for a utility conduit or the like comprising the steps of providing a tool head that has elongated body structure and a cutting face at one end of said elongated body structure, cutting bit structure fixed to and projecting forwardly from said cutting face, and structure defining a cutting fluid orifice in said cutting face adjacent said cutting bit structure, attaching said elongated body structure to a drill string such that said cutting tool face is offset from the axis of said drill string, concurrently rotating and advancing said tool head along an underground path to move said cutting bit structure in orbital boring action about said drill string axis while concurrently directing a high velocity jet of cutting fluid from said orifice defining structure at an angle to said drill string axis in the same direction as said cutting tool face is offset from said drill string axis to bore a substantially straight underground passage, and advancing said tool head along an underground path without rotation while concurrently directing said high velocity jet of cutting fluid from said orifice defining structure at an angle to said drill string axis in the same direction as said cutting tool face is offset from said drill string axis to produce a change in direction of said underground passage in the direction of said high velocity jet of cutting fluid.

21. The method of claim 20 and further including the step of flowing said jet of cutting fluid from said orifice defining structure at a velocity of at least about thirty meters per second concurrently with the rotation and advancement of said tool head along said underground path to bore said substantially straight underground passage.

22. The method of claim 21 wherein said elongated body structure includes a portion that extends at an angle to said tool axis, said cutting bit structure including pilot structure that defines a pilot axis offset from said tool axis, said coupling structure is adapted to attach said elongated body to a drill string so that said portion of said elongated body is at an angle to the axis of said drill string, said pilot axis is at an angle to the axis of said drill string, and the direction of said high velocity jet is at a greater angle to the axis of said drill string than said pilot axis.

23. The method of claim 22 wherein said cutting fluid orifice defining structure includes a plurality of said cutting fluid orifices in said cutting face, and each said cutting fluid orifice in said cutting face includes a nozzle with an orifice of less than three millimeters diameter.

24. The method of claim 23 wherein said tool head is of ferrous material, said cutting bit structure is of carbide material, and said cutting bit structure includes first and second cutting bit members, said second cutting bit member being fixed to and projecting forwardly from said cutting face and extending generally perpendicularly to said first cutting bit member.

25. The method of claim 23 wherein said cutting bit structure includes generally parallel side surfaces that are connected by inclined front surfaces that join at an apex that defines said pilot axis.

26. The method of claim 25 wherein said cutting face is of ellipto conical form.

* * * * *